US006775983B2

(12) United States Patent
Sanderson et al.

(10) Patent No.: US 6,775,983 B2
(45) Date of Patent: Aug. 17, 2004

(54) FLOW CONTROL DEVICE FOR A COMBUSTOR

(75) Inventors: Simon Ralph Sanderson, Niskayuna, NY (US); Paolo Graziosi, Clifton Park, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 10/063,864

(22) Filed: May 21, 2002

(65) Prior Publication Data

US 2003/0217544 A1 Nov. 27, 2003

(51) Int. Cl.[7] ..... F23R 3/04
(52) U.S. Cl. ..... 60/722; 60/748
(58) Field of Search ..... 60/39.23, 737, 60/748, 785, 722; 431/350, 354

(56) References Cited

U.S. PATENT DOCUMENTS 3,643,431 A * 2/1972 Jamieson ..... 60/39.23
3,910,035 A * 10/1975 Juhasz et al. ..... 60/39.23
6,301,899 B1 10/2001 Dean et al.
6,334,297 B1 * 1/2002 Dailey et al. ..... 60/785

* cited by examiner

*Primary Examiner*—Louis J. Casaregola
(74) *Attorney, Agent, or Firm*—Sughrue Mion, PLLC

(57) ABSTRACT

A flow control device for a combustor is provided in which the flow control device comprises a shroud having a first end and a second end wherein the second end is coupled to the combustor. The shroud is disposed to receive a primary fluid and disposed to direct the primary fluid into the combustor. In addition, the shroud further comprises a plurality of ports disposed therein wherein the ports are oriented to extract a portion of a flow from a flow path of the primary fluid so as to control a flow rate of the primary fluid through the shroud.

16 Claims, 5 Drawing Sheets

FLOW CONTROL DEVICE FOR A COMBUSTOR

BACKGROUND OF INVENTION

The present invention relates generally to combustion equipment, and more particularly to a flow control device for a combustor.

Gas turbine engines utilized in civilian and military aircraft typically adhere to emission and pollution standards. Reduction of such emissions, for example, is typically accomplished throughout the flight of the aircraft inclusive of take-off, climb, cruise and descent wherein it is desirable to optimize the burning of a fuel and an oxidizer (typically air) within a combustion chamber under all the abovementioned operating conditions.

The flow of air and the flow of fuel into the primary combustion zone of the combustion chamber vary greatly as a function of engine rotational speed and fuel feed conditions. The disparities in air-fuel richness are great between low and full power operating modes of the engine. During low power operation, the air-fuel mixture is lean and the engine typically emits a large amount of carbon dioxide in some designs. During this operational phase, air flow, pressure, temperature and air-fuel richness are comparatively low and, as a result, the rate of combustion within the combustion chamber is also relatively low. Accordingly, the air flow desirably is limited during low power operation in order to enrich the air-fuel mixture in the combustion chamber primary zone.

Under high power, (also know as full power) operating conditions, the air-fuel mixture is commonly relatively rich. Under these conditions, the exhaust emissions are typically high in both visible smoke and nitrogen oxides. In order to reduce these emissions, it is desirable to increase the flow of primary air into the combustion chamber to make the fuel mixture in the primary zone leaner and to decrease the dwell time of the combustion gases in the combustion chamber. Therefore, it can be appreciated that it is desirable to control the flow of the air, for example, in relation to the operational mode of the engine.

Industrial power generation gas turbines typically include a compressor for compressing air wherein the air is subsequently mixed with fuel and ignited in a combustor for generating combustion gases. The combustion gases flow to a turbine that extracts energy for driving a shaft to power the compressor and also produces output power for powering an electrical generator. In addition, the turbine is typically operated for extended periods of time at a relatively high base load for powering the generator to produce electrical power in a utility grid, for example. In such turbines, flame stability and engine operability dominate the combustor design requirements. As such, the flow rate of air affects a recirculation flow pattern in the combustion chamber (recirculation of the burned products with incoming fuel) and thereby affects the flame stability, the level of nitrous oxide emissions (NOx) and the ability to control the load in the turbine.

Accordingly, there is a need in the art for a combustor having improved flow control of air into the combustor reaction zone.

SUMMARY OF INVENTION

One embodiment of the present invention comprises a flow control device for a combustor in which the flow control device comprises a shroud having a first end and a second end wherein the second end is coupled to the combustor. The shroud is disposed to receive a primary fluid and disposed to direct the primary fluid into the combustor. In addition, the shroud further comprises a plurality of ports disposed therein wherein the ports are oriented to extract a portion of a flow from a flow path of the primary fluid so as to control a flow rate of the primary fluid through the shroud.

BRIEF DESCRIPTION OF DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
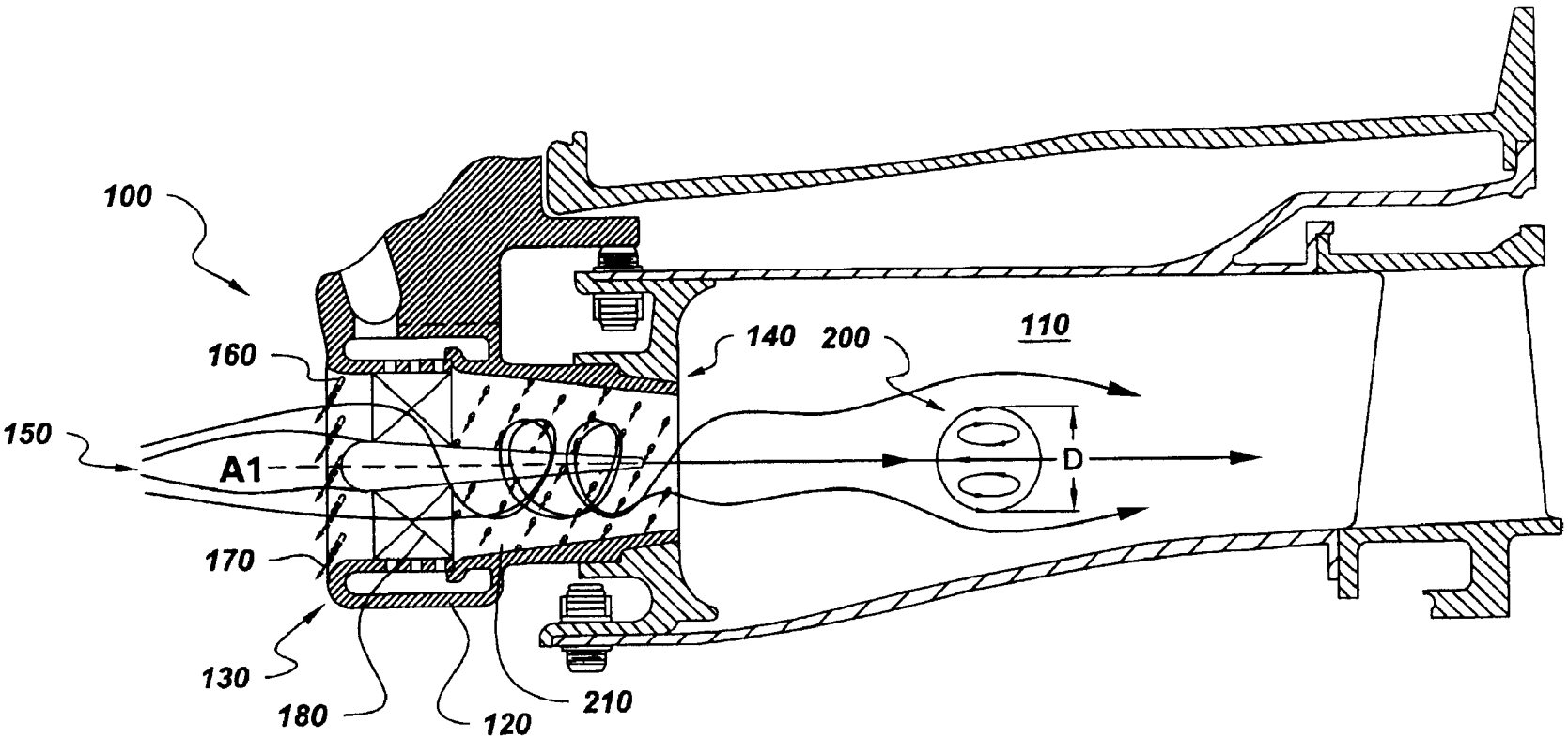
FIG. 1 is a cross sectional view of a flow control device for a turbine combustor in accordance with one embodiment of the present invention.

In one embodiment of the present invention, a flow control device 100 comprises a shroud 120 having a first end 130 and a second end 140 wherein the second end 140 is coupled to a combustor 110 (see FIG. 1). The shroud 120 is disposed to receive a (meaning at least one) primary fluid 150, typically a gas, so as to direct the primary fluid 150 into the combustor 110. The shroud 120 further comprises a plurality of ports 160 (hereinafter ports 160) disposed therein, wherein the ports 160 are oriented to extract a portion (not shown) of a flow from a flow path of the primary fluid 150 or induce a flow variation to the flow path of the primary fluid 150 and control the rate of the flow through the shroud 120 (discussed below). As used herein, the terms "thereon", "therein", "over", "above", "under" and the like are used to refer to the relative location of elements of flow control device 100 as illustrated in the Figures and are not meant to be a limitation in any manner with respect to the orientation or operation of flow control device 100. The flow control device 100 is typically disposed in, but not limited to, gas ranges, furnaces and gas turbines.

Figure 2:
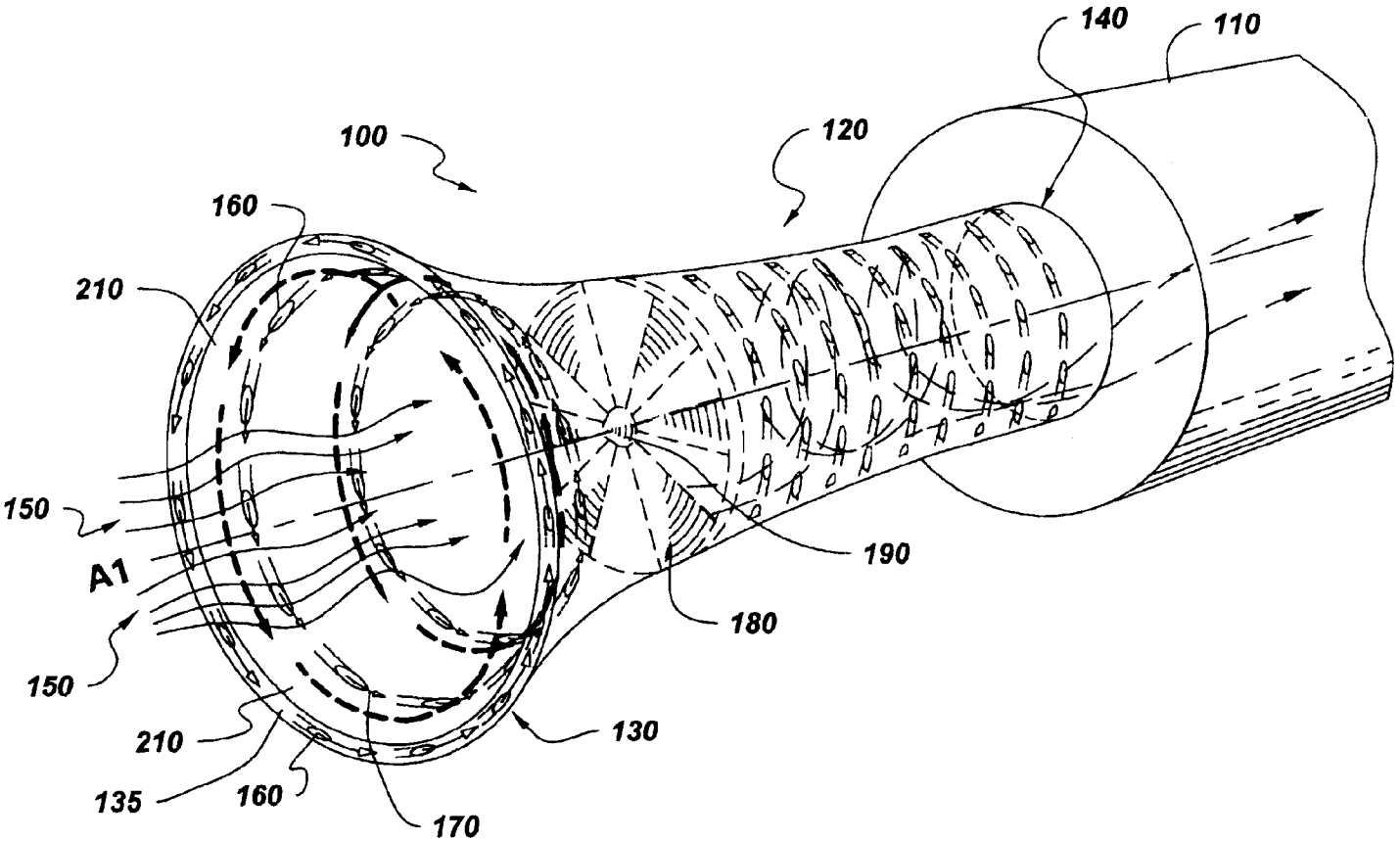
FIG. 2 is a perspective view of the flow control device of FIG. 1 in accordance with another embodiment of the present invention.

Conventional flow control devices typically comprise, a (meaning at least one) swirler 180 disposed within the shroud 120 (see FIG. 2). The primary fluid 150 is typically introduced through the first end 130 of the shroud 120 and is directed through the shroud 120 by the swirler 180 and the ports 160. In one embodiment of the present invention, the shroud 120 is flared radially outward so as to allow an increase of flow of the primary fluid 150 therein compared to conventional non-flared shrouds. As used herein, the term "flared" refers to the shape of the shroud 120 wherein the shroud 120 widens radially from the second end 140 towards the first end 130. In addition, the swirler 180 typically comprises a plurality of circumferentially spaced apart vanes disposed around a centerbody 190. The circumferentially spaced apart vanes are configured for "swirling" the primary fluid 150 through the shroud 120. As used herein, the term "swirling" refers to the shape of the flow path of the primary fluid 150 upon entering the flow control device 100, wherein the shape of the flow path is a spiral or vortex shape (as depicted in the shroud 120 by dashed spiral arrows in drawing FIGS. 2–3).

In one embodiment of the present invention, a secondary fluid 170 is introduced into the flow path of the primary fluid 150 so as to induce a flow variation in the flow path of the primary fluid 150 and thereby control the mass flow rate of the primary fluid 150 through the shroud 120 (as depicted in the ports 160 by arrows having hollow arrowheads in drawing FIG. 2). It will be appreciated that the number and location of the ports 160 in the Figures are used by way of illustration and not limitation and that the size, shape, number and location of the ports 160 typically vary depending upon the desired flow rate of the primary fluid 150 through the shroud 120. In one embodiment, the ports 160 are disposed on a first surface 135 of the shroud 120 and are oriented to induce a flow variation in the primary fluid 150 so as to control the flow of the primary fluid 150 through the shroud 120. In another embodiment, the shroud 120 comprises an internal shroud surface 210 wherein the ports 160 are disposed therein. In a further embodiment, the ports 160 are disposed on the first surface 135 of the shroud 120 and disposed on the internal shroud surface 210. In operation, the ports 160 induce a flow variation in the primary fluid 150 by introducing the secondary fluid 170 into the flow path of the primary fluid 150 so as to increase or decrease the swirling action of the primary fluid 150 through the swirler 180 and thereby increase or decrease the recirculation and subsequent mixing of the primary fluid 15 and the burned products (not shown) in the combustion chamber of the combustor 100. Increasing or decreasing the swirling action typically causes an increase or decrease in the size (designated "D") of a recirculation flow pattern 200 (see FIG. 1) of the burned products in the combustor 100. As such, the flame in the combustor 110 and the level of nitrous oxide emissions are in part controlled by the introduction of the secondary fluid 170 into the flow path of the primary fluid. In addition, the introduction of the secondary fluid 170 to the primary fluid 150 results in controlling the ratio of primary fluid 150 to fuel entering the combustor 100.

The ports 160, singly (not shown) or in combination with the swirler 180 (see FIG. 2), serve to provide a vortex effect to the primary fluid 150 thereby restricting the flow path of the primary fluid 150 through the shroud 120. As used herein, the term "vortex effect" refers to the vortex created by the introduction (or injection) of the secondary fluid 170 to the flow path of the primary fluid 150 which increases or decreases the flow of the primary fluid 150 into the shroud 120 due to a radial pressure gradient generated by the vortex. For example, increasing the amount of secondary fluid 170 introduced to the flow of the primary fluid 150 increases the pressure gradient in the vortex, thereby restricting the flow of the primary fluid 150 through the shroud 120. The pressure gradient produced by the vortex is dependent upon the flow control device 100 parameters such as size, shape, location and angle of the ports 160 and the characteristics of the secondary fluid 170 flowing through them. Such parameters typically vary depending upon the desired pressure gradient of the vortex to limit the flow of the primary fluid 150. Thus, by varying the amount of secondary fluid 170 injected into the primary fluid 150, the ports 160 serve to enhance the swirling action created by the swirler 180 and serve to control the flow of the primary fluid 150 through the shroud 120.

Figure 4:
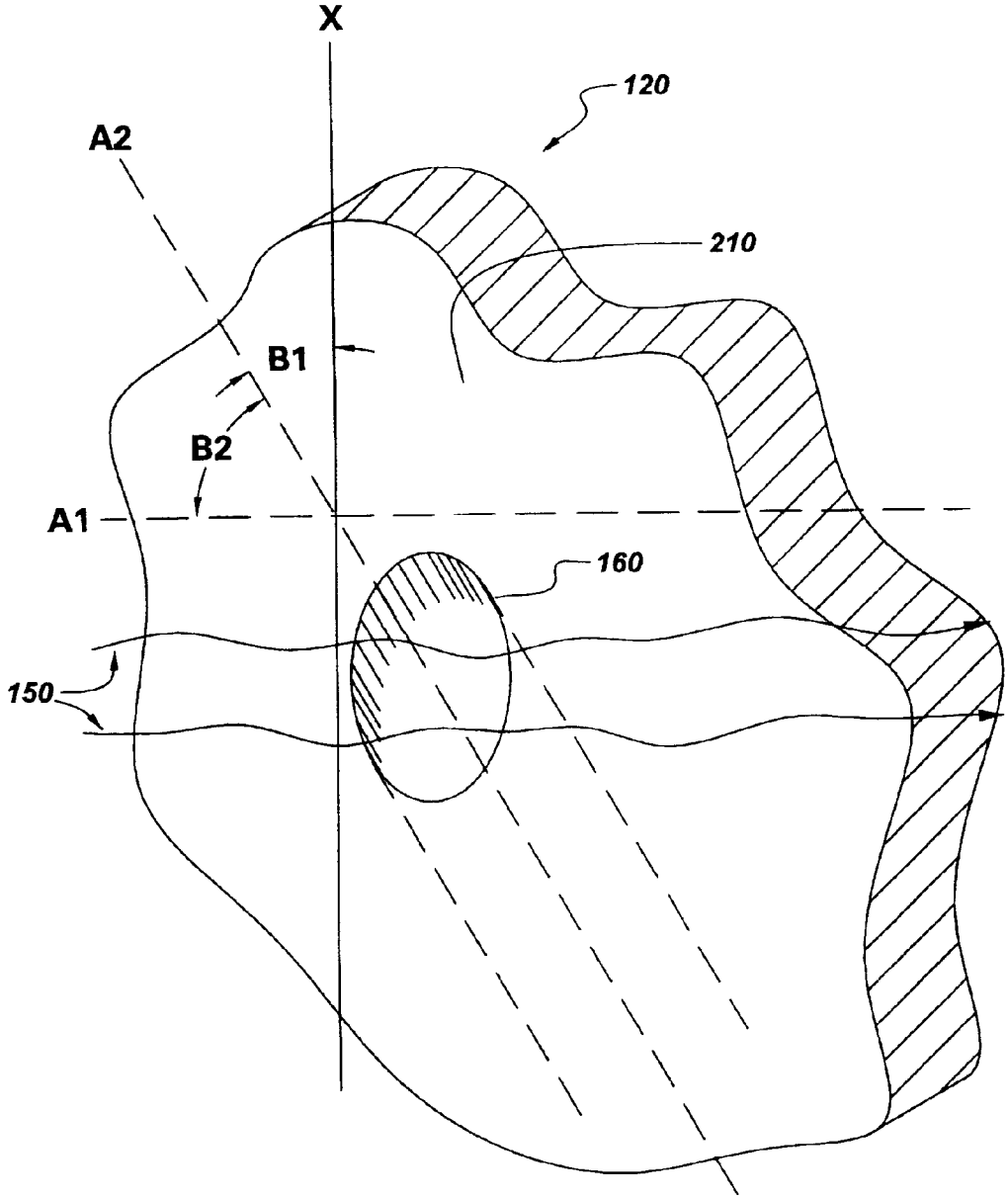
FIG. 4 is a perspective view of a respective port disposed in an internal shroud surface in accordance with another embodiment of the present invention.
Figure 5:
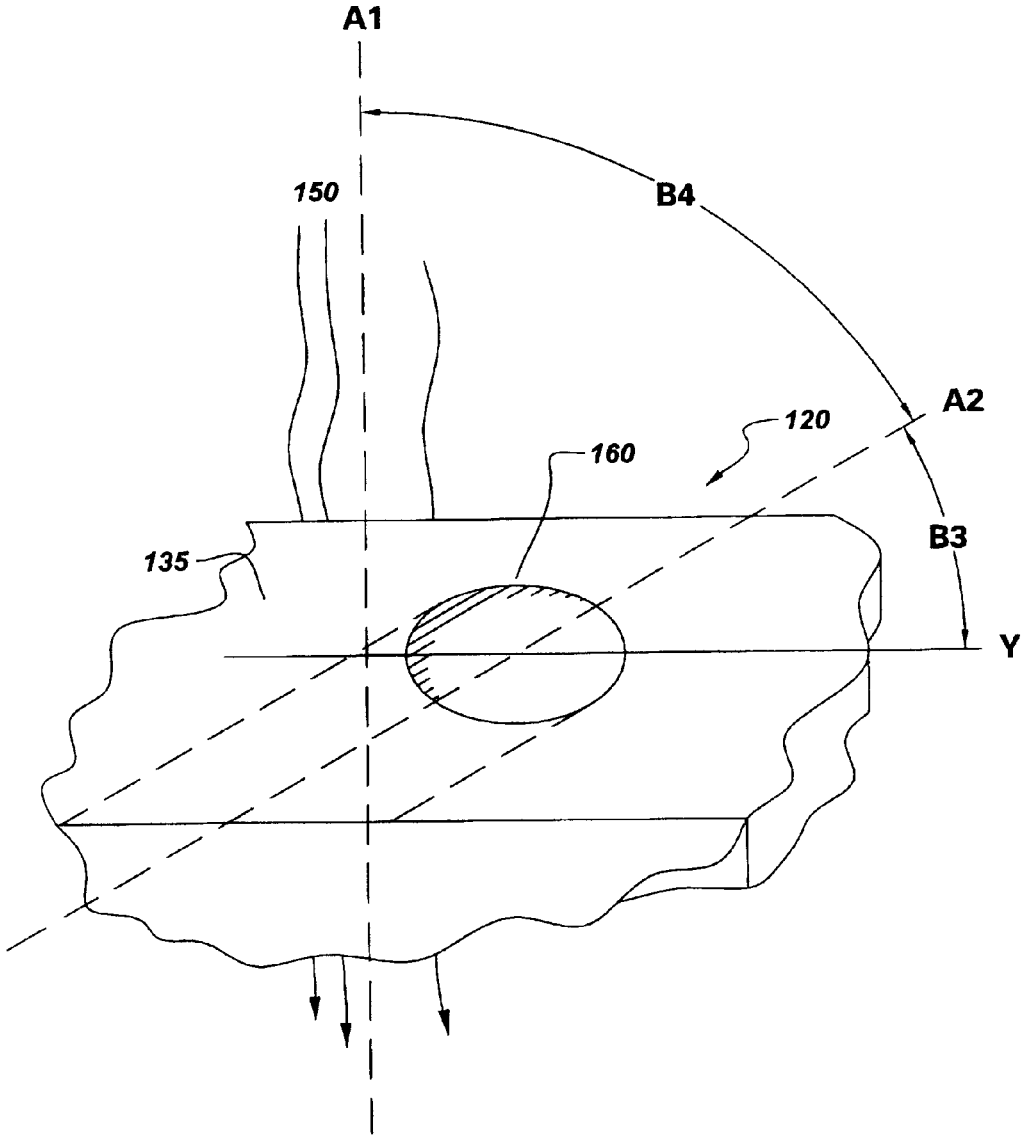
FIG. 5 is a perspective view of a respective port disposed in a first surface of a shroud in accordance with another embodiment of the present invention.

As discussed above, the pressure gradient produced by the vortex is dependent in part on the angle of the ports 160. A first angle (designated "B1") of a respective one of the ports 160 disposed on the internal shroud surface 210 is defined from a port axis (designated "A2") to the internal shroud surface 210 (angle shown to reference line "x" running tangentially to the internal shroud surface 210), wherein the first angle "B1" is in the range between about 0 degrees to about 45 degrees (see FIG. 4). It will be appreciated that the port axis "A2" is at an angle to an axis "A1", wherein axis "A1" is a generally longitudinally extending axis of the shroud 120. A second angle (designated "B2") of the respective one of the ports 160 on the internal shroud surface 210 is defined from the port axis "A2" to the generally longitudinally extending axis "A1", wherein the second angle "B2" is in the range between about 5 degrees to about 25 degrees. A third angle (designated "B3") of a respective one of the ports 160 disposed on the first surface 135 of the shroud 120 is defined from the port axis "A2" to the first surface 135 of the shroud 120 (angle shown to reference line "Y" running tangentially to the first surface 135 of the shroud 120), wherein the third angle "B3" is in the range between about 5 degrees to about 25 degrees (see FIG. 5). In addition, a fourth angle (designated "B4") of the respective one of the ports 160 disposed on the first surface 135 of the shroud 120 is defined from the port axis "A2" to the generally longitudinally extending axis "A1", wherein the fourth angle "B4" is in the range between about 0 degrees to about 45 degrees. In an exemplary embodiment, the cross-sectional bore shape of the ports 160 is circular. However, it will be appreciated that the cross-sectional bore shape is typically selected, but not limited to, from shapes consisting of circular, oval, rectangular and combinations thereof. In addition, the direction of rotation of the primary fluid 150 and the angle of the ports 170 in the Figures are used by way of example and not limitation and the direction and the angle typically vary depending upon the operating conditions of the device 100 and the desired flow rate of the primary fluid 150 through the shroud 120.

Figure 3:
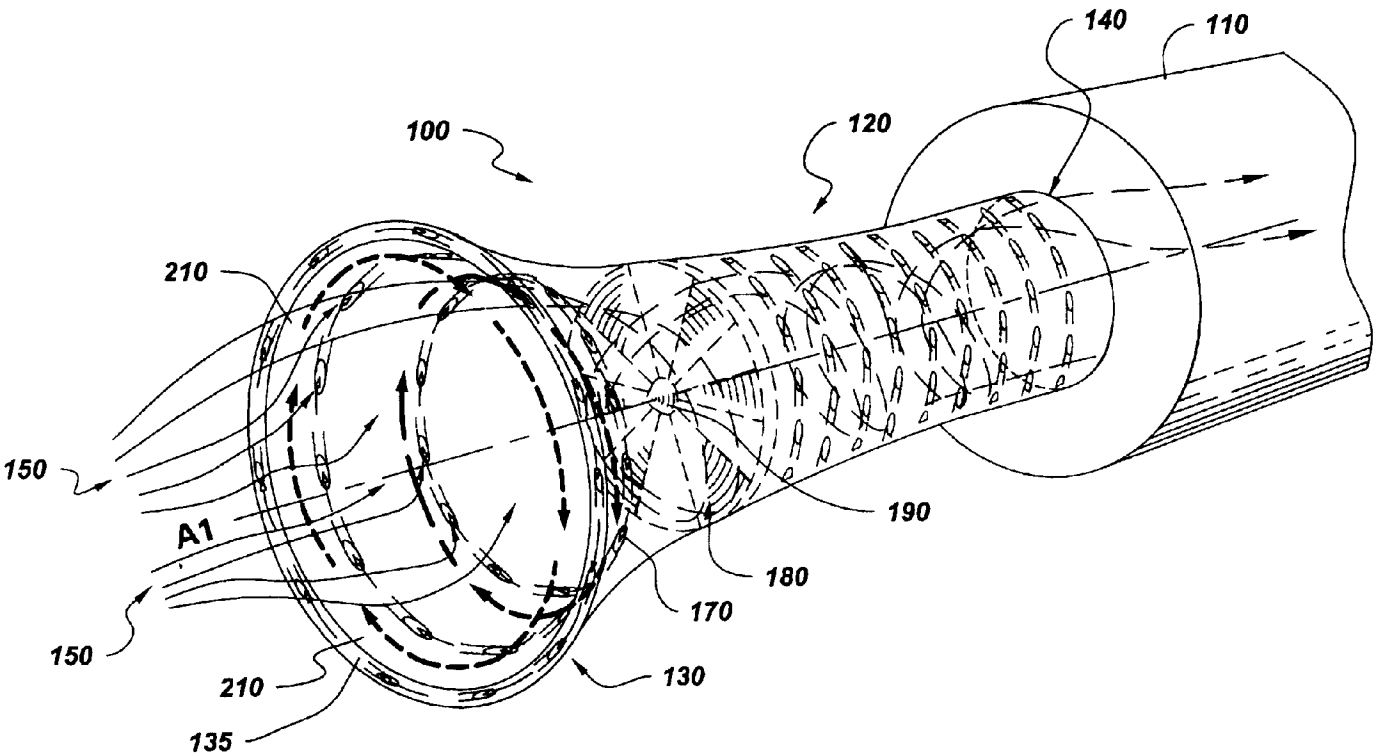
FIG. 3 is a perspective view of the flow control device of FIG. 1 in accordance with another embodiment of the present invention.

In another embodiment of the present invention, the ports 170 induce a flow variation in the primary fluid 150 by extracting a portion of the flow from the flow path of the primary fluid 150 so as to control the flow rate of the primary fluid 150 through the shroud 120 (see FIG. 3). In this embodiment, the extraction of a portion of the flow from the flow path of the primary fluid 150 by the ports 170 results in the vortex effect to the primary fluid 150 (as shown by the dashed spiral arrows rotating clockwise in drawing FIG. 3). As a result, the vortex and corresponding radial pressure gradient of such vortex effect serve to restrict the flow of the primary fluid 150 into the shroud 120. As used herein, the term "extracting" refers to the extraction of a portion of the flow of the primary fluid 150 through the ports 160. The extraction is typically accomplished by connecting the ports 160 to a lower pressure point in an upstream portion of a compressor or a downstream portion in a gas turbine (not shown). In addition, the rate of flow through the ports 160 is typically regulated by valves (not shown) implemented in the piping or manifold system of such compressor or turbine. It will be appreciated that the number and location of the ports 160 in the Figures are used by way of illustration and not limitation and that the size, shape, number, angle and location of the ports 160 typically vary depending. upon the desired flow rate of the primary fluid 150 through the shroud 120.

It will be apparent to those skilled in the art that, while the invention has been illustrated and described herein in accordance with the patent statutes, modification and changes may be made in the disclosed embodiments without departing from the true spirit and scope of the invention. It is, therefore, to be understood that the appended claims are intended to cover all such modifications and changes as fall within the true spirit of the invention.

What is claimed is:

1. A flow control device for a combustor, said flow control device comprising:

a shroud having a first end and a second end wherein said second end is coupled to said combustor, said shroud being disposed to receive a primary fluid and disposed to direct said primary fluid into said combustor, said shroud further comprising a plurality of ports disposed therein, said ports oriented to extract a portion of a flow from a flow path of said primary fluid so as to control a flow rate of said primary fluid through said shroud, wherein an angle of a respective one of the ports disposed on an internal shroud surface is defined from a port axis to said internal shroud surface, wherein said angle is in the range between about 5 degrees to about 25 degrees.

2. The flow control device of claim 1, wherein said primary fluid is a gas.

3. The flow control device of claim 1, wherein said device is disposed in a machine selected from the group consisting of gas ranges, furnaces and turbines.

4. The flow control device of claim 1, wherein said internal shroud surface having said plurality of ports disposed therein.

5. The flow control device of claim 4, wherein said plurality of ports are disposed circumferentially around said internal shroud surface.

6. The flow control device of claim 1, wherein said plurality of ports are disposed circumferentially around said internal shroud surface.

7. The flow control device of claim 1 further comprising a swirler having a plurality of circumferentially spaced apart vanes disposed to cause rotation about an axis of said flow path in said primary fluid.

8. The flow control device of claim 1, wherein another angle of a respective one other of the ports disposed on said internal shroud surface is defined from a port axis to said internal shroud surface, wherein said another angle is in the range between about 0 degrees to about 45 degrees.

9. The flow control device of claim 1, wherein another angle of a respective one other of the ports disposed on said internal shroud surface is defined from a port axis to a longitudinally extending axis of said shroud, wherein said another angle is in the range between about 5 degrees to about 25 degrees.

10. The flow control device of claim 1, wherein another angle of a respective one other of the ports disposed on said internal shroud surface is defined from a port axis to an axis of said flow path of said primary fluid, wherein said another angle is in the range between about 0 degrees to about 45 degrees.

11. The flow control device of claim 1, wherein said shroud is a flared shroud.

12. A flow control device for a combustor, said flow control device comprising:

a shroud having a first end and a second end wherein said second end is coupled to said combustor, said shroud being disposed to receive a primary fluid and disposed to direct said primary fluid into said combustor, said shroud further comprising a plurality of ports disposed therein, said ports oriented to extract a portion of a flow from a flow path of said primary fluid so as to control a flow rate of said primary fluid through said shroud, wherein a first angle of a respective one of the ports disposed on an internal shroud surface is defined from a port axis to said internal shroud surface, wherein said first angle is in the range between about 0 degrees to about 45 degrees, and wherein a second angle of a respective one of the ports disposed on an internal shroud surface is defined from a port axis to a longitudinally extending axis of said shroud, wherein said second angle is in the range between about 5 degrees to about 25 degrees.

13. The flow control device of claim 12, wherein a third angle of a respective one of the ports disposed on said internal shroud surface is defined from a port axis to said internal shroud surface, wherein said third angle is in the range between about 5 degrees to about 25 degrees.

14. The flow control device of claim 13, wherein a fourth angle of a respective one of the ports disposed on said internal shroud surface is defined from a port axis to an axis of said flow path of said primary fluid, wherein said fourth angle is in the range between about 0 degrees to about 45 degrees.

15. A flow control device for a combustor, said flow control device comprising:

a shroud having a first end and a second end wherein said second end is coupled to said combustor, said shroud being disposed to receive a primary fluid and disposed to direct said primary fluid into said combustor, said shroud further comprising a plurality of ports disposed therein, said ports oriented to extract a portion of a flow from a flow path of said primary fluid so as to control a flow rate of said primary fluid through said shroud, wherein an angle of a respective one of the ports disposed on an internal shroud surface is defined from a port axis to a longitudinally extending axis of said shroud, wherein said angle is in the range between about 5 degrees to about 25 degrees.

16. A flow control device for a combustor, said flow control device comprising:

a shroud having a first end and a second end wherein said second end is coupled to said combustor, said shroud being disposed to receive a primary fluid and disposed to direct said primary fluid into said combustor, said shroud further comprising a plurality of ports disposed therein, said ports oriented to extract a portion of a flow from a flow path of said primary fluid so as to control a flow rate of said primary fluid through said shroud, wherein an angle of a respective one of the ports disposed on an internal shroud surface is defined from a port axis to an axis of said flow path of said primary fluid, wherein said angle is in the range between about 0 degrees to about 45 degrees.

* * * * *